US007310912B2

(12) United States Patent
Lenney et al.

(10) Patent No.: US 7,310,912 B2
(45) Date of Patent: Dec. 25, 2007

(54) RAIN GUTTER DEBRIS PRECLUSION DEVICE

(76) Inventors: Robert C. Lenney, 3150 Edgewood La., Newcastle, CA (US) 95658; John Lewis, 4105 Mercer Dr., Modesto, CA (US) 95658

( * ) Notice: Subject to any disclaimer, the term of this patent is extended or adjusted under 35 U.S.C. 154(b) by 44 days.

(21) Appl. No.: 10/944,167

(22) Filed: Sep. 16, 2004

(65) Prior Publication Data

US 2006/0123710 A1 Jun. 15, 2006

Related U.S. Application Data

(60) Provisional application No. 60/503,610, filed on Sep. 16, 2003.

(51) Int. Cl.
*E04D 13/00* (2006.01)
*B01D 33/00* (2006.01)
*B01D 24/00* (2006.01)

(52) U.S. Cl. ..... 52/12; 210/162; 210/474

(58) Field of Classification Search ..... 52/11, 52/12, 15; 248/48.1; 210/474, 162; 405/43, 405/45; 404/2; 119/530, 527, 450, 480, 119/509

See application file for complete search history.

(56) References Cited

U.S. PATENT DOCUMENTS 672,701 A * 4/1901 Daniel ..... 248/48.1
2,229,381 A * 1/1941 Grow ..... 52/12
2,288,121 A * 6/1942 Sandmeyer et al. ..... 52/12
2,583,422 A * 1/1952 Haddon ..... 210/498
4,646,488 A 3/1987 Burns
4,745,710 A 5/1988 Davis
4,949,514 A 8/1990 Weller
5,010,696 A 4/1991 Knittel
5,107,635 A * 4/1992 Carpenter ..... 52/12
5,261,195 A 11/1993 Buckenmaier et al.
5,406,754 A * 4/1995 Cosby ..... 52/12
5,617,678 A * 4/1997 Morandin et al. ..... 52/11
5,640,809 A 6/1997 Iannelli
5,729,931 A * 3/1998 Wade ..... 52/12

(Continued)

OTHER PUBLICATIONS

Preferred Distributing, Inc.; "How it Works" Section of LeafFilter Web Site and Photographs of the LeafFilter Gutter Protection Product; www.leaffilter.com; Unknown Date; Plainwell, MI.

*Primary Examiner*—Richard E. Chilcot, Jr.
*Assistant Examiner*—Adriana Figueroa
(74) *Attorney, Agent, or Firm*—Heisler & Associates

(57) ABSTRACT

A barrier is provided to preclude debris from passing into a rain gutter. The barrier includes a screen supported upon a channel. The channel includes a tab positionable between a roof and shingles upon the roof, and with a lip opposite the tab resting upon a portion of a gutter opposite the roof. The channel includes a recess between the tab and the lip. The recess includes a floor defining a lower plane of the channel. Ribs extend from the floor up to an upper plane of the channel in which the screen is supported. The ribs have sufficient height to remain in contact with the screen. Water is drawn through the screen and along the ribs down to the floor of the recess. Apertures in the floor allow the water to fall down through the channel and into the gutter, while debris is precluded from passing through the screen.

1 Claim, 2 Drawing Sheets

U.S. PATENT DOCUMENTS 6,134,843 A * 10/2000 Tregear ..... 52/12
6,205,715 B1 * 3/2001 Rex, Jr. ..... 52/12
6,598,352 B2 * 7/2003 Higginbotham ..... 52/12
6,942,419 B2 * 9/2005 Knak et al. ..... 404/4

* cited by examiner

RAIN GUTTER DEBRIS PRECLUSION DEVICE

CROSS-REFERENCE TO RELATED APPLICATIONS

This application claims benefit under Title 35, United States Code §119(e) of U.S. Provisional Application No. 60/503,610 filed on Sep. 16, 2003.

FIELD OF THE INVENTION

The following invention relates to barriers for rain gutters and similar structures for keeping leaves and other debris out of the rain gutters. More particularly, this invention relates to rain gutter debris preclusion barriers which utilize a screen to allow water to pass into the gutter, but to preclude debris from passing into the gutter.

BACKGROUND OF THE INVENTION

Keeping rain gutters free of debris is a common nuisance for home owners. When debris such as leaves, shingle residue, and other material collect within a rain gutter, the rain gutter is prone to becoming clogged and ceasing to function to carry water in a desirable fashion off of the roof and away from the building. Not only is the process of cleaning gutters of such debris a nuisance, it also entails significant risk of injury, particularly when the rain gutters are elevated high above the ground.

To remedy this undesirable situation, numerous products have been developed to keep debris from collecting within a rain gutter, so that the cleaning of the gutters can be avoided. For representative sampling of such prior inventions, see U.S. Pat. No. 4,646,488 (Burns), U.S. Pat. No. 4,745,710 (Davis), U.S. Pat. No. 4,949,514 (Weller), U.S. Pat. No. 5,010,696 (Knittel), U.S. Pat. No. 5,261,195 (Buckenmaier), U.S. Pat. No. 5,640,809 (Iannelli), U.S. Pat. No. 6,134,843 (Tregear) and U.S. Pat. No. 6,598,352 (Higginbotham).

Some such prior art gutter debris guards utilize some form of screen which allows water to pass through but precludes debris. Such screen-based gutter debris guards present a difficult technical problem. If the apertures in the screen are too large, then debris will pass through the openings in the screen, causing the device to fail. If the openings are slightly smaller, the debris can become lodged within the apertures themselves, plugging up the apertures and providing a homeowner with a new challenge involved in cleaning debris out of the screen itself. Also, if the openings are large, the screen must either be of very high strength material, or be subject to bending or other collapse when a large amount of debris is located upon the screen. At the other extreme, if the openings are too small, surface tension forces in the water will cause a film of water to span the openings in the screen and the water will roll across the screen and not pass through the screen into the gutter. With such fine mesh screens, water is thus not adequately allowed to pass through the screen and water spills over the gutters, preventing the gutter from functioning at all.

The patent to Higginbotham (U.S. Pat. No. 6,598,352) teaches one solution to this problem. In particular, the screen is supported from below by a series of vertical legs that extend up to elliptical heads which support the screen thereon. With the elliptical heads of the legs in contact with the screen, adhesion forces in the water are beneficially utilized to provide a wetted path of surface material wicking the water down through the screen along these legs where the water is then further allowed to drop down into the gutter.

While the Higginbotham skeletal support structure with included screen supporting legs is generally effective, it exhibits some drawbacks which have been addressed by this invention. In particular, the skeletal structure including the legs and included ellipses is rather complex in form. It is not easily attached to rain gutters, and is not conveniently formed for supporting the included screen. Also, Higginbotham teaches use of multiple structures together underlying the screen, rather than utilizing a simplified single structure to support the screen and assist in drawing the water through the screen and into the gutter. Higginbotham is attached to the gutter only, rather than between the roof and the gutter. Such attachment results in more difficult installation.

SUMMARY OF THE INVENTION

This invention provides a rain gutter debris preclusion barrier which satisfies the aforementioned need for a rain gutter debris preclusion barrier. Particularly, a channel is provided for placement over at least a portion of a rain gutter and which supports a screen upon the channel. The channel is configured to rest along one edge between a roof and shingles upon the roof, and at another edge adjacent a portion of a gutter spaced from a roof, such that the channel need only be attached at the edge adjacent the front of the gutter. The channel is preferably formed of a single constant cross-sectional structure with a recess below portions of the channel abutting the gutter and the roof. Ribs extend up from a floor of the recess to an upper plane in which the screen is located. The ribs are thus available to draw water through the screen by providing a wetted surface for capillary action forces to assist in drawing water through fenestrations in the screen and down to the floor of the channel. Apertures in the channel are provided with sufficient size to allow the water collecting on the floor to drop through the apertures and into the rain gutter.

OBJECTS OF THE INVENTION

Accordingly, a primary object of the present invention is to provide a barrier for preventing debris from passing into a rain gutter, while allowing water to pass into the rain gutter.

Another object of the present invention is to provide a rain gutter debris barrier which traps very small debris before the debris passes into the rain gutter, while allowing water to pass into the rain gutter.

Another object of the present invention is to provide a rain gutter debris barrier which covers the entire rain gutter.

Another object of the present invention is to provide a rain gutter debris preclusion device which is easy to install in a highly secure fashion.

Another object of the present invention is to provide a rain gutter debris barrier which is of high strength and durable in performance.

Another object of the present invention is to provide a rain gutter debris barrier which resists deterioration when exposed to direct sunlight and extremes of temperatures.

Another object of the present invention is to provide a rain gutter debris barrier which is easy to manufacture.

Another object of the present invention is to provide a method for precluding debris from a rain gutter which operates reliably and minimizes an amount of gutter maintenance for a homeowner.

Other further objects of the present invention will become apparent from a careful reading of the included drawing figures, the claims and detailed description of the invention.

DESCRIPTION OF THE PREFERRED EMBODIMENT

Figure 1:
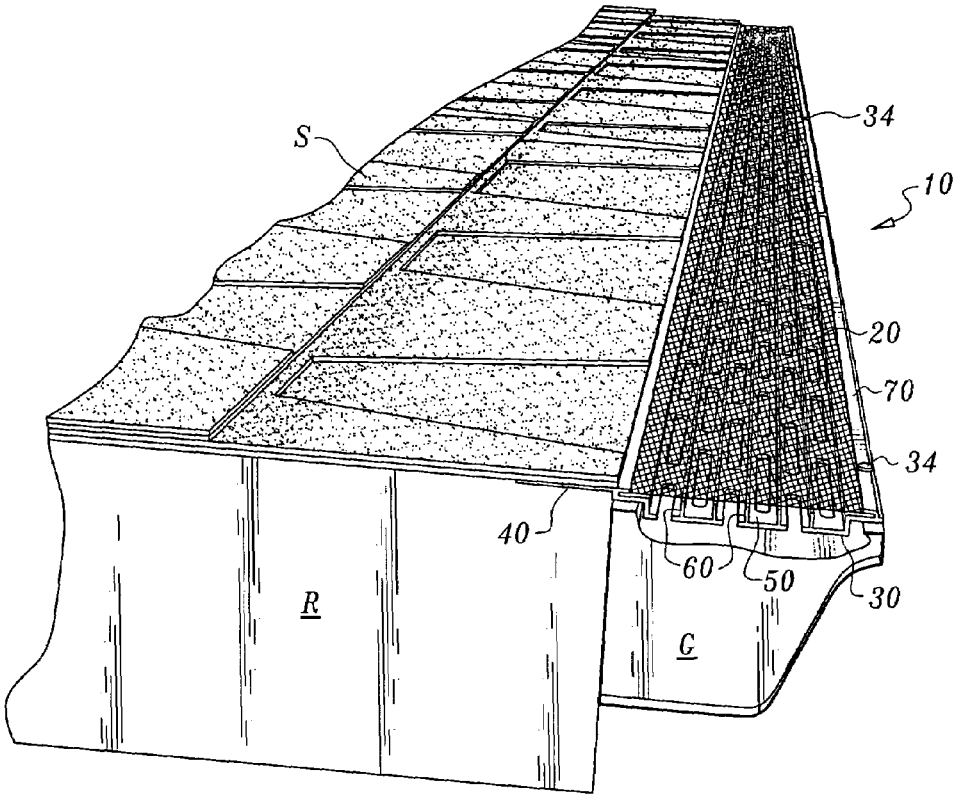
FIG. 1 is a perspective view of a roof with a rain gutter mounted thereon and with the rain gutter debris preclusion device of this invention mounted upon the gutter and the roof.

Referring to the drawings, wherein like reference numerals represent like parts throughout the various drawing figures, reference numeral 10 (FIGS. 1 and 2) is directed to a barrier for preclusion of debris from a rain gutter G mounted upon a roof R. Water W traveling off of shingles S upon the roof R pass onto a screen 20 of the barrier 10. A channel 30 is located beneath the screen 20 and supports the screen 20 in position while also drawing the water W through the screen 20 and into the channel 30 for further delivery down into the rain gutter G. Any debris falling off of the shingles S and onto the screen 20 of the barrier 10 either remain upon the barrier 10 or fall off of the screen 20 and away from the gutter G so that the gutter G can remain free of debris and functioning properly.

Figure 2:
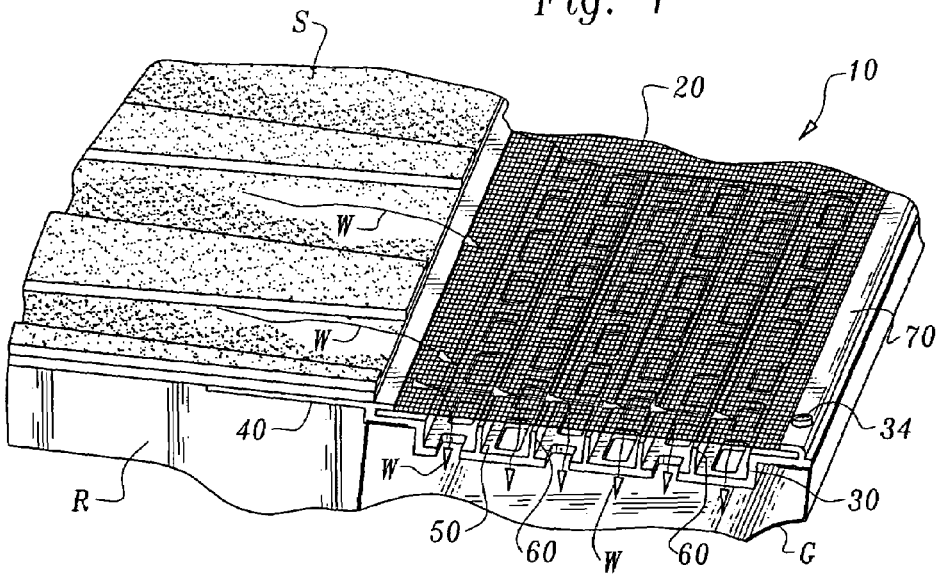
FIG. 2 is a detail of a portion of that which is shown in FIG. 1 with arrows indicating a path followed by water passing off of the roof and through the barrier into the rain gutter.

In essence, and with particular reference to FIGS. 1 and 2, the basic details of the barrier 10 of this invention are described. The barrier 10 is comprised of two parts including the screen 20 and the channel 30. The screen 20 precludes debris from passing into the gutter G (FIG. 1) while allowing the water W (FIG. 2) to pass into the gutter G. The channel 30 is provided to support the screen 20 in the desired position and orientation for the screen 20. The channel 30 also functions to draw the water W through the screen 20 by capillary action so that the water W desirably passes into the gutter G.

The channel 30 includes a tab 40 at an upper end. The tab 40 preferably fits directly between the shingles S and the felt or other vapor barrier upon the roof R, so that an upper side of the channel 30 is supported in the desired position overlying the gutter G. For convenience, the roof R is considered to include all portions of the covering of a building except for the shingles S. The shingles S are considered to include the uppermost layer of material, and can be "composite" shingles, tile, wood shake, slate, stone, or any other roofing material available to provide the uppermost layer. A recess 50 defines a portion of the channel 30 adjacent the tab 40. The recess 50 includes a floor 56 defining a lowermost portion of the channel 30. A series of ribs 60 extend up from the floor 56 of the recess 50 to support the screen 20 in the desired position above the floor 56 of the recess 50. A lip 70 defines an edge of the channel 30 opposite the tab 40. The lip 70 is adapted to be secured to a portion of the gutter G most distant from the roof R, such as with a screw 34 or other fastener.

Figure 3:
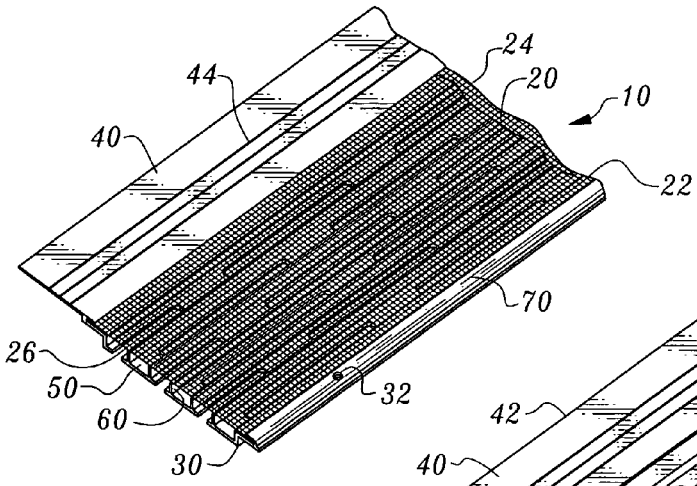
FIG. 3 is a perspective view of a portion of the rain gutter debris preclusion device of this invention alone.

More specifically, and with particular reference to FIGS. 1-3, details of the screen 20 of the barrier 10 are described. The screen 20 can be any form of fenestrated structure capable of allowing water to pass therethrough but blocking debris from passing therethrough. The screen 20 is preferably formed of a flexible material with uniformly sized fenestrations. Most particularly, this screen 20 is formed of stainless steel woven wire with the fenestrations in the screen 20 sized to provide approximately 8,000 holes per square inch. With such small fenestrations, twigs, sand and leaf stems are precluded from sticking in the fenestrations, and practically all debris harmful to the proper functioning of the gutter G is precluded from passing therethrough.

The screen 20 includes a lower edge 22 parallel with and spaced from an upper edge 24. The edges 22, 24 are spaced apart by a distance similar to a width of the gutter G away from the roof R of a structure. The screen 20 includes side edges 26 extending between the lower edge 22 and upper edge 24 at ends of sections of the barrier 10. Typically the barrier 10 is provided in separate sections for convenience in covering rain gutters G of various different lengths.

FIGS. 1-3 show fenestrations in the screen 20 larger than actually preferred, so that the fenestrations can be clearly seen. Most preferably, the fenestrations are smaller than those shown in the drawings. Alternatively, a screen 20 with larger fenestrations can be utilized, particularly in environments where the debris to be precluded is not susceptible to becoming lodged in such larger fenestrations, or where higher flows can lead to screen 20 blockage with debris, such as roof valleys.

Figure 4:
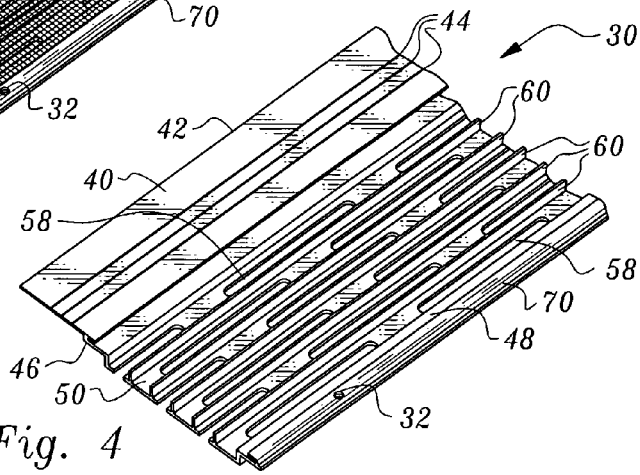
FIG. 4 is a perspective view of the channel portion of the rain gutter debris preclusion device of this invention.
Figure 5:
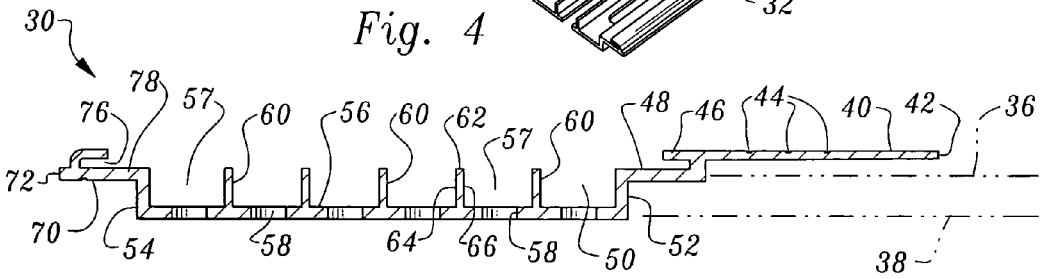
FIG. 5 is a full sectional view of that which is shown in FIG. 4.
Figure 6:
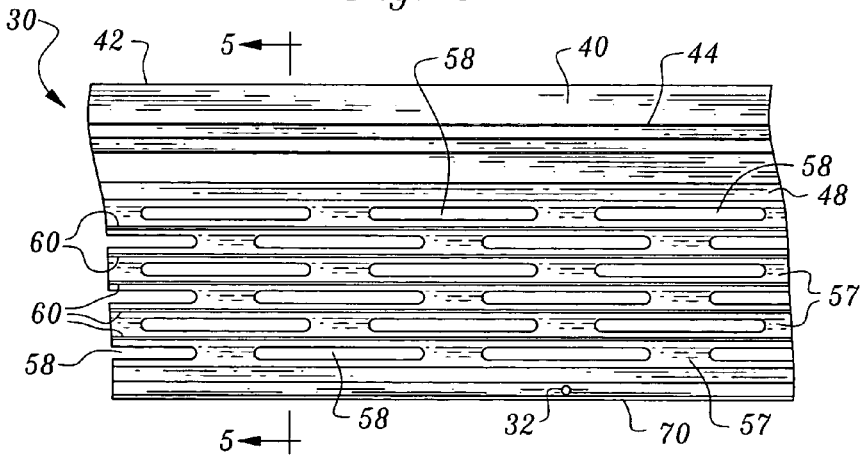
FIG. 6 is a top plan view of that which is shown in FIG. 4.

With particular reference to FIGS. 4-6, details of the channel 30 of the barrier 10 are described. The channel 30 provides a rigid underlying structure for supporting the screen 20 where desired over the gutter G, and for encouraging water W migration through the screen 20 by capillary action. The channel 30 also provides for mounting of the barrier 10 upon the gutter G and roof R. Particularly, mounting holes 32 are preferably provided along a forward edge of the channel 30. Screws 34 (FIGS. 1 and 2), such as sheet metal screws, can pass through the mounting holes 32 and be threaded into a portion of the gutter G most distant from the roof R. The barrier 10 is thus securely held in position over the gutter G.

The channel 30 is preferably shaped to have a constant cross-sectional form. Preferably, the channel 30 is formed of rigid die extruded aluminum. The channel 30 has most of the material thereof aligned with either an upper plan 36 or a lower plane 38 (FIG. 5) which are preferably parallel and spaced from each other.

A tab 40 extends in a planar fashion near, but slightly above the upper plane 36 and is adapted to be located closest to the roof R. This tab 40 secures a portion of the channel 30 opposite where the mounting holes 32 and screws 34 are utilized to fasten to the gutter G. Particularly, the tab 40 is adapted to fit between the roof R and shingles S to secure one side of the channel 30. Between the tab 40 and the screws 34, the barrier 10 is securely held in place over the gutter G.

The tab 40 includes a tip 42 which defines a portion of the channel 30 most distant from the mounting holes 32. The tip 42 also defines a width of the tab 40. Preferably, this tab 40 width is sufficient to cause the tab 40 to be securely held just beneath the shingles S. Typically, this distance is at least one centimeter and most preferably two to three centimeters. The tab 40 includes notches in surfaces thereof, to increase the ability of the tab 40 to be shortened, if the tab 40 is excessively wide.

The tab 40 is shown extending parallel with other portions of the channel 30 generally. If a particularly steeply pitched roof is provided, it is conceivable that the tab 40 could be bent so that it is oriented in a plane distinct from other portions of the channel 30. Alternatively, the tab 40 can be shortened or entirely removed to accommodate steeply pitched roofs.

The tab 40 includes a tab slot 46 for supporting the upper edge 24 of the screen 20. The tab slot 46 is closed on three sides (when viewed such as in FIG. 5), with one open side in the tab slot 46. The open side of the tab slot 46 faces a lip slot 76 adapted to hold the lower edge 22 of the screen 20 (described in detail below). An upper shelf 48 defines one side of the tab slot 46 below the tab slot 46 which extends further than other portions of the slot 46 and within the upper plane 36. This upper shelf 48 supports a portion of the screen 20, and discourages buckling of the screen 20 in a downward fashion when loaded with debris or otherwise encountering forces which would tend to drive the screen 20 downwardly.

The recess 50 defines a portion of the channel 30 extending between the tab 40 and the lip 70 which is below the upper plane 36 and extending down to the lower plane 38. The upper plane can generally be defined as including the tab slot 46 and the lip slot 76 (described in detail below). The recess 50 includes an upper wall 52 and a lower wall 54 on opposite sides of the recess 50. Each of the walls 52, 54 extend from the upper plane down to the lower plane.

A floor 56 is aligned with the lower plane 38 and extending between lower portions of the walls 52, 54. The floor 56 and lower plane are preferably parallel with the upper plane so that a constant spacing is maintained for the recess 50 between the floor 56 and a position where the screen 20 lies between the tab slot 46 and the lip slot 76.

The floor 56 includes a plurality of apertures 58 passing therethrough. These apertures 58 are preferably elongate with a significantly greater length than width and with a length thereof extending parallel with a long axis of the channel 30. The floor 56 is broken up into a plurality of troughs 57 between adjacent ribs 60. Each of the troughs 57 preferably include a plurality of apertures 58 therein. Preferably, the apertures 58 are closer to a rib 60 on a lower side of each trough 57 than a rib 60 on an upper side of each trough 57. Because the entire lower plane and upper plane are tilted such that the tab 40 is elevated above the lip 70, locating of the apertures 58 closer to the ribs 60 on the lower side of the trough 57 decreases the possibility of puddling of water within the troughs 57.

The apertures 58 are sufficiently large so that no degree of surface tension in the water W can tend to cause a film to span the apertures 58 which might otherwise preclude water W migration through the apertures 58. Thus, once water W is within the troughs 57 and adjacent a floor 56, the water quickly passes through the apertures 58 to drip off of a lower surface of the recess 50 of the channel 30.

A plurality of ribs 60 extend up from the floor 56 of the recess 50, with the ribs 60 extending from the lower plane 38 up to the upper plane 36. Each of the ribs 60 includes a free end 62 adjacent the upper plane 36 and a base end 64 connected to the floor 56. Each of the ribs 60 preferably include sides 66 which are planar from the base end 64 up to the free end 62.

The free end 62 is preferably generally thin with the free ends 62 supporting the screen 20 over the recess 50 and the channel 30. Not only do the ribs 60 support the screen 20 so that the screen 20 can remain within the upper plane 36, but the ribs 60 also provide a wetted path between the screen 20 and the floor 56 so that capillary action can draw water W (FIG. 2) from the upper surface of the screen 20, down through the fenestrations in the screen 20 to the surfaces of the ribs 60 and then on down to the floor 56 where the water W can pass through the apertures 56 and fall down off of the recess 50 of the channel 30 and into the gutter G. Preferably, the ribs 60 are each of a similar height and each of a similar width and extend perpendicularly between the lower plane 38 at the floor 56 to the upper plane 36 adjacent the screen 20.

The lower wall 56 of the recess 50 transitions into the lip 70 of the channel 30. The lip 70 supports the mounting holes 32 and screws 34 (FIGS. 1 and 2) for securing the channel 30 to the gutter G. The lip 70 extends to a tip 72 defining a portion of the channel 30 most distant from the tab 40. The lip slot 76 is a mirror image of the tab slot 46 and is located within the upper plane 36 facing the tab slot 46. A lower shelf 78 extends between the lip slot 76 and the lower wall 54 of the recess 50. The lower shelf 78 further supports a portion of the screen 20 adjacent the lip slot 76 to discourage the screen 20 from being deflected downward into the recess 50.

The slots 46, 76 preferably have sufficient depth so that the lower edge 22 and upper edge 24 of the screen 20 can be securely held within the slots 46, 76 without requiring fastening of the screen 20 within the slots 46, 76. A sealant or other adhesive is preferably used to further secure the screen 20 within the slots 46, 76. Alternatively, the screen 20 can be fastened within the slots 46, 76 or otherwise fastened to the channel 30, such as through adhesive, fasteners, welding, brazing, or other coupling techniques.

In use and operation, and with particular reference to FIGS. 1 and 2, details of the installation and use of the barrier 10 of this invention are described. Initially, the barrier 10 is installed upon the gutter G. Particularly, lengths of the barrier 10 are placed over the gutter G with the lip 70 resting upon a forward edge of the gutter G. Screws 34 or other fasteners are utilized to secure the lip 70 to the gutter G. Before the screws 34 are utilized, the tab 40 is slid between the shingles S and the roof R. If necessary, the tab 40 can be removed to accommodate a steeply pitched roof R and then transition to allow the remaining portions of the channel 30 to extend over the gutter G to the lip 70 where the lip 70 supports the screw 34 for fastening of the channel 30 to the gutter G.

At ends of the gutter G, excess portions of the barrier 10 can be cut utilizing a saw for cutting of the aluminum and scissors or other cutting tools for cutting of the material forming the screen 20. Where outside corners are encountered in the gutter G, the channel 30 can be cut at a 45° angle. At inside corners, most preferably the screen 20 is replaced with a screen having larger fenestrations. Most preferably, such an alternative screen would have sixteen fenestrations per inch in each direction (256 per square inch). In this way, the greater concentration of debris tending to gather at inside corners will not block the screen 20. Alternatively, other forms of joints can be utilized to position the barrier 10 where desired at inside and outside corners over corresponding bends in the gutter G.

Between linear sections of barriers 10, a seam extends from the tabs 40 to the lips 70. Preferably, this joint is covered to preclude debris entrapment at this joint. Particularly, a "finger" of thin aluminum can be slid into the slots 46, 76 of each barrier 10 to cover the screens 20 where edges thereof on adjacent barriers 10 come together. A similar covering is also preferably provided at outside corner joints between adjacent barriers 10. Such fingers also help to interlock adjacent barriers 10 together. At ends of the gutters G, end caps are provided to cover the screen 20 edge and preclude debris and insects from getting under the screen 20 and/or the barrier 10.

Once the barrier 10 has been installed, function of the barrier 10 occurs as follows. When rain strikes the shingles S upon the roof R, the water W travels down off of the shingles S toward the gutter G. The water W will have a tendency to draw debris down the shingles S. Similarly, wind and gravity will tend to draw debris down towards the gutters G. When the water W reaches an edge of the shingles S, it falls off of the shingles S and down onto the barrier 10. Particularly, the water W will either strike portions of the tab 40 just above the screen 20, or pass directly onto the screen 20. In either case, the water W travels downward because the barrier 10 is slightly angled so that the water is traveling toward the lip 70.

Debris entrained with the water W will impact the screen 20 and remain upon the screen 20 or bounce over the upper surface of the screen 20 and fall off of the barrier 10 to the ground. Rain also helps to splash debris off of the screen 20. The water W will wet surfaces of the screen 20. Because the channel 30 includes a recess 50 below the screen 20 and ribs 60 extending up to the screen 20, the water W impacting the screen 20 will, through capillary action and adhesion properties in water molecules, tend to wet all of the surfaces contacting the screen 20, including the ribs 60 extending up from the floor 56 in the recess 50 of the channel 30. Once the ribs 60 have become wetted, a wet path exists all the way down to the floor 56. No surface tension barrier thus exists and the water W is drawn by gravity down through the fenestrations in the screen 20, along surfaces of the ribs 60, and down into the troughs 57 between the ribs 60 on the floor 56 of the recess 50. The apertures 58 allow the water W to fall down through the floor 56 of the recess 50 and into the rain gutter G for collection of the water W and distribution of the water W away from the structure.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A rain gutter debris barrier, comprising of:

a channel adapted to overlie at least a portion of a rain gutter;

a screen, said screen having fenestrations therein adapted to allow water to flow therethrough, but to preclude debris larger than said fenestrations from passing therethrough, said screen located over said channel;

said channel including a floor with apertures therein;

said channel including a plurality of ribs extending up from said floor into contact with said screen;

wherein said channel includes a tab adapted to be placed between shingles and a roof upon which said shingles are mounted, said tab being generally flat;

wherein said ribs each have a common height between a base end of each rib adjacent said floor and a free end of each rib opposite said base end;

wherein said floor is planar;

wherein said tab includes a tab slot, said tab slot closed on three sides and open on one side, when said tab slot is viewed in a section perpendicular to a long axis of said ribs, said open side of said tab slot defining a portion of said slot closest to said ribs, said tab slot located within a plane parallel with said floor and spaced from said floor and aligned with said free ends of said ribs;

wherein said channel includes a lip on an edge thereof opposite said tab, said lip adapted to be supported upon a portion of a rain gutter most distant from the roof, said lip including a lip slot oriented in a common plane with said tab slot, with said lip slot facing said tab slot, both said tab slot and said lip slot spaced apart a distance substantilly equal to a width of said screen, said tab slot and said lip slot having a width sufficient to allow said screen to be oriented and supported therein, said screen oriented within both said tab slot and said lip slot and with said screen in contact with each of said ribs;

wherein said tab includes an upper shelf between said tab slot and said ribs, and wherein said lip includes a lower shelf between said lip slot and said ribs, said upper shelf and said lower shelf oriented in a common plane aligned with said free ends of said ribs;

wherein said free end of each said rib terminates at a plane coplanar with said upper shelf and said lower shelf, said upper shelf and said lower shelf adapted to support said screen thereon, with said free ends of said ribs also supporting said screen with said screen remaining within a common plane with said upper shelf, said lower shelf and said free ends of said ribs;

wherein said ribs each include sides which are planar and flat from said base end to said free end, with said sides oriented perpendicular to said floor and parallel with each other, said sides being of common height on each said rib with said free end extending between said sides of each said rib in a flat plane perpendicular to said sides along a full width of said free end and parallel with said floor, said sides of each said rib having a constant distance from each other defining a constant width of each said rib from said base end to said free end, with no portion of said rib wider than said constant width, and with portions of said free ends which contact said screen having a same width as said constant width between said sides;

wherein said base ends of said ribs are each connected to said floor of said channel with said floor of said channel remaining in a plane parallel with said upper shelf and said lower shelf, said floor defining a lowermost portion of said channel from which said barrier is adapted to allow water to fall freely into the rain gutter below said barrier, said floor formed integrally with said ribs, said upper shelf and said lower shelf such that said channel including said ribs, said floor, said upper shelf and said lower shelf are all provided as a single unit, said ribs remaining free from other portions of the barrier between said base end of each said rib to said free end of each said rib, said ribs having no portion thereof extending below said floor and each base end of each said rib attached to said floor and formed along with said floor;

wherein said channel is substantially rigid;

wherein said channel is formed of aluminum;

wherein said screen is formed of stainless steel;

wherein said fenestrations in said screen are provided in a quantity of about 8,000 holes per square inch;

wherein said channel includes at least two troughs between at least three adjacent said ribs, said at least two troughs each including said apertures therein, said apertures sized sufficiently large to prevent surface tension in water from blocking water travel through said apertures; and wherein said apertures within each said trough are located closer to an adjacent one of said ribs closest to said lip than an adjacent one of said ribs closest to said tab.

* * * * *